US009006590B2

(12) United States Patent
Bailey et al.

(10) Patent No.: US 9,006,590 B2
(45) Date of Patent: Apr. 14, 2015

(54) FLAME-QUENCHING KEYPAD ASSEMBLY

(75) Inventors: Edward J. Bailey, Cypress, TX (US); Arthur T. Jones, Jr., Houston, TX (US)

(73) Assignee: Rosemount Analytical Inc., Houston, TX (US)

( * ) Notice: Subject to any disclaimer, the term of this patent is extended or adjusted under 35 U.S.C. 154(b) by 239 days.

(21) Appl. No.: 13/566,380

(22) Filed: Aug. 3, 2012

(65) Prior Publication Data

US 2013/0032461 A1 Feb. 7, 2013

Related U.S. Application Data

(60) Provisional application No. 61/514,576, filed on Aug. 3, 2011.

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/06*** | (2006.01) |
| ***H01H 13/86*** | (2006.01) |

(52) U.S. Cl.

CPC ..... *H01H 13/06* (2013.01); *H01H 13/86* (2013.01); *H01H 2221/024* (2013.01); *H01H 2223/002* (2013.01); *H01H 2223/008* (2013.01); *H01H 2239/036* (2013.01); *H01H 2239/072* (2013.01)

(58) Field of Classification Search

USPC ..... 200/5 A

See application file for complete search history.

(56) References Cited

U.S. PATENT DOCUMENTS

| | | | | |
|---|---|---|---|---|
| 3,236,989 | A * | 2/1966 | Zavertnik et al. | 200/294 |
| 3,988,552 | A * | 10/1976 | Faben | 200/19.22 |
| 4,027,120 | A * | 5/1977 | Chateau | 200/19.22 |
| 6,344,622 | B1 * | 2/2002 | Takiguchi et al. | 200/314 |
| 6,455,795 | B1 * | 9/2002 | Murakami et al. | 200/345 |
| 7,196,282 | B2 * | 3/2007 | Mitsuoka et al. | 200/516 |
| 7,371,985 | B2 * | 5/2008 | Chen | 200/302.1 |

FOREIGN PATENT DOCUMENTS

CN 101465227 A 6/2009

(Continued)

OTHER PUBLICATIONS

Notification of Transmittal of the International Search Report and Written Opinion for corresponding International application No. PCT/US12/049495, dated Oct. 17, 2012.

Rosemount Analytical Model 2350A Gas Chromatograph Controller. Product Data Sheet. Jul. 2012. Model 2350A Gas Controller. 71-RAI-PGC-PDS-Model2350A.

(Continued)

*Primary Examiner* — Renee Luebke
*Assistant Examiner* — Lheiren Mae A Caroc
(74) *Attorney, Agent, or Firm* — Christopher R. Christenson; Kelly, Holt & Christenson, PLLC

(57) ABSTRACT

A process analytic device includes a metallic enclosure having electronics disposed therein. The enclosure has an enclosure wall with a reference surface. A plurality of operating rods is provided. Each operating rod is configured to pass through an aperture in the enclosure wall and to cooperate with the enclosure wall to provide a flame quenching pathway. A plurality of electrical switches is provided where each electrical switch is aligned with a respective operating rod, and is mounted a controlled distance from the reference surface. Each operating rod transfers movement to a respective electrical switch through the flame quenching pathway.

28 Claims, 7 Drawing Sheets

(56) References Cited

FOREIGN PATENT DOCUMENTS

| | | | |
|---|---|---|---|
| DE | 4312736 | A1 | 10/1994 |
| DE | 10225920 | A1 | 11/2003 |
| DE | 102004034544 | A1 | 2/2006 |
| EP | 2109126 | A2 | 10/2009 |
| JP | S60205917 | A | 10/1985 |
| JP | 2005180878 | A | 7/2005 |

OTHER PUBLICATIONS

X-Stream Enhanced: XEFD—Flameproof Gas Analyzer. Product Data Sheet. May 2012. X-Stream Enhanced XEFD. 71-PDS-103-XEFD.

First Office Action from Counterpart Chinese Patent Application No. 201280003075.4, Issuing Date: Oct. 28, 2014, 8 pages with English Translation.

* cited by examiner

FLAME-QUENCHING KEYPAD ASSEMBLY

CROSS-REFERENCE TO RELATED APPLICATION

The present application is based on and claims the benefit of U.S. provisional patent application Ser. No. 61/514,576, filed Aug. 3, 2011, the content of which is hereby incorporated by reference in its entirety.

BACKGROUND

Process analyzers and instruments are commonly used for the monitoring, optimization and control of processes which include hazardous or flammable gases and liquids. Typical applications include gas processing, refining, chemical and petro-chemical processes. It is a requirement in many of these applications for the instrumentation and analyzers to meet strict safety criteria in order to protect against fire and explosion. Examples of process instrumentation and analyzers that must meet such safety criteria include gas or liquid analyzers, such as a combustion analyzer or process gas chromatograph, and/or other process indicators.

There are a number of known designs and methods for providing hazardous area protection depending on the industry and world area. Variations are often driven by safety standards in each area or jurisdiction. Methods of protection include explosion proof/flameproof electronics enclosures; purging electronics enclosures with non-flammable gas; employing electronics that comply with one or more intrinsic safety specifications, and others.

A typical flameproof or explosion proof enclosure includes a heavy metal casting that is usually constructed from aluminum. A challenge for such products is to provide an easy to use operator interface that still complies with the appropriate safety criteria. Such operator interface options typically include non-contact keypad buttons such as infrared, magnetic or Hall-effect keypad buttons, or complex operator rod keypads.

Known operator interfaces are thus complex, expensive, and typically are difficult to use. Moreover, such interfaces also lack the feel of a more conventional membrane keypad used on general purpose industrial and household equipment.

Providing a low-cost flameproof operator interface that has a tactile feel similar to known conventional membrane keypads would advance the art of operator interfaces in hazardous or explosive areas.

SUMMARY

A process analytic device includes a metallic enclosure having electronics disposed therein. The enclosure has an enclosure wall with a reference surface. A plurality of operating rods is provided. Each operating rod is configured to pass through an aperture in the enclosure wall and to cooperate with the enclosure wall to provide a flame quenching pathway. A plurality of electrical switches is provided where each electrical switch is aligned with a respective operating rod, and is mounted a controlled distance from the reference surface. Each operating rod transfers movement to a respective electrical switch through the flame quenching pathway.

DETAILED DESCRIPTION OF ILLUSTRATIVE EMBODIMENTS

Embodiments of the present invention generally provide for an explosion proof or flameproof keypad assembly that has a membrane keypad feel; offers a high level of environmental protection or sealing; and requires minimal machining to facilitate implementation on blind or limited access enclosures. Moreover, some embodiments of the present invention help provide accurate location of an inner key switch matrix relative to an external keypad overlay such that consistent keypad feel and switch actuation is assured without adjustment or any machining of reference surfaces on the interior of the enclosure.

Figure 1:
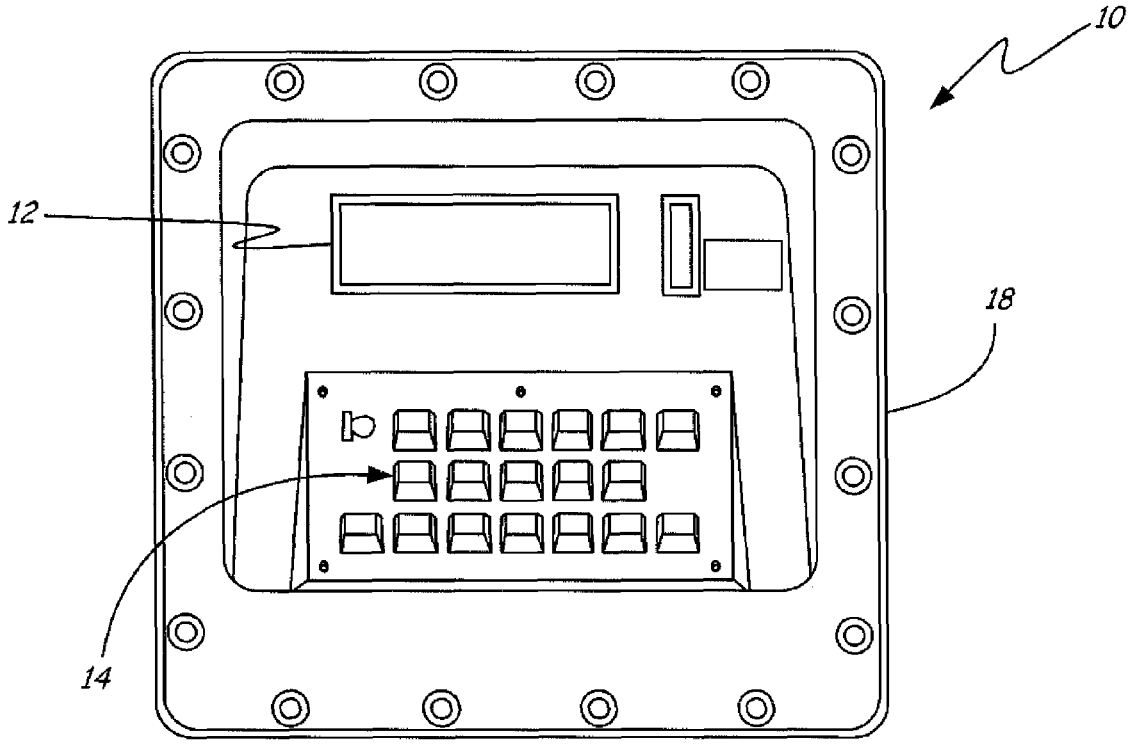
FIGS. 1 and 2 are diagrammatic front and side views of an exemplary process analytic device employing an explosion proof enclosure for which embodiments of the present invention are particularly applicable.
Figure 2:
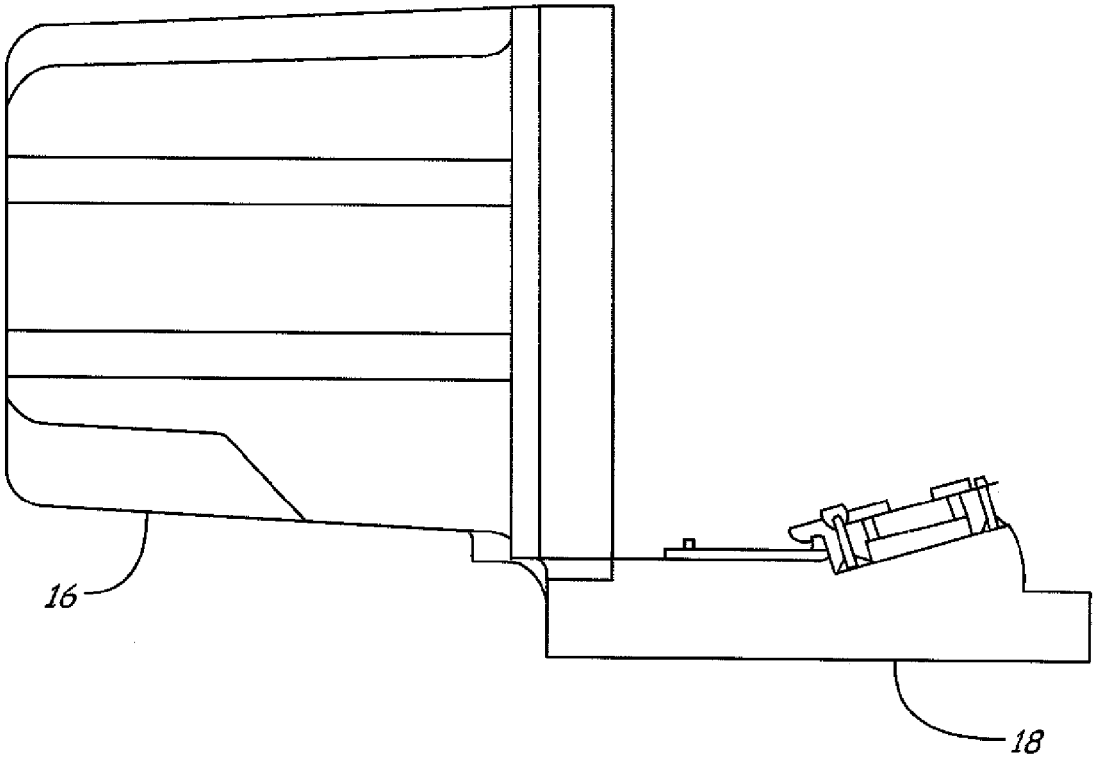

FIGS. 1 and 2 are diagrammatic front and side views of an exemplary process analytic device employing an explosion proof enclosure for which embodiments of the present invention are particularly applicable. Device 10 is a gas chromatograph controller sold under the trade designation Model 2350A available from Rosemount Analytical Inc., of Houston, Tex. Another example of a process analytic device for which embodiments of the present invention are particularly useful is sold under the trade designation X-STREAM Enhanced XEFD-Flameproof Gas Analyzer available from Rosemount Analytical. However, embodiments of the present invention are practicable with any electrical device that has an explosion proof enclosure and an operator interface. Device 10 has an operator interface that includes display 12 and operator input buttons 14. Display 12 can be any suitable display. In one embodiment, display 12 is an LCD display. Device 10 also include metal enclosure 16 (shown in FIG. 2) that is designed to comply with one or more industry-accepted standards from approval agencies such as CSA, UL, FM, ATEX and IEC to provide flame and explosion safe operation. One example of an explosion proof rating for enclosure 16 is an ATEX certification to EEx d IIB T6 standards EN50015 and EN50018 for potentially explosive atmospheres Parts 1 and 5. Although the embodiment illustrated in FIGS. 1 and 2 provides a hingedly-connected front panel 18, other methods of coupling front panel 18 to enclosure 16 can be employed as long as they comply with applicable standards.

Figure 3:
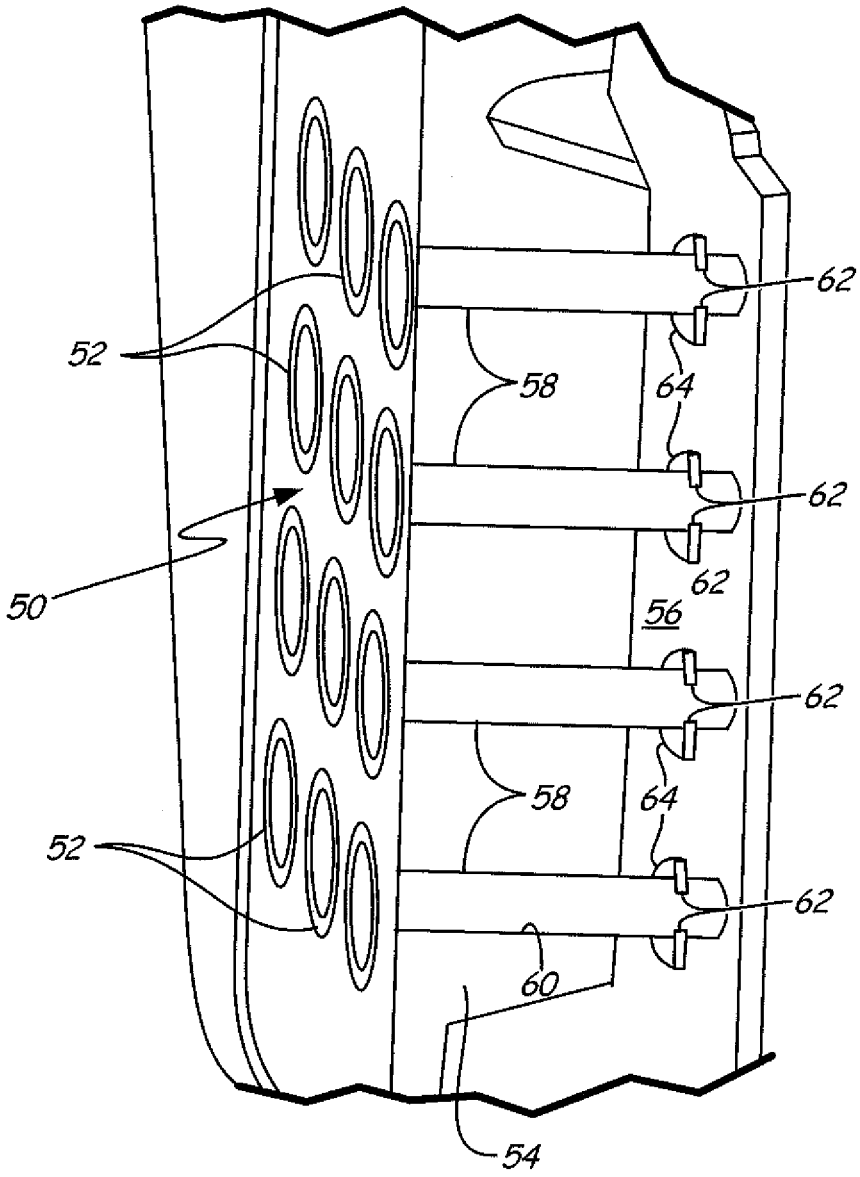
FIG. 3 is a cross-sectional view of a portion of an operator interface in accordance with an embodiment of the present invention.

FIG. 3 is a cross-sectional view of a portion of an operator interface in accordance with an embodiment of the present invention. Explosion proof button array 50 includes a plurality of operator buttons 52. Each operator button 52 is disposed on an external surface of explosion proof enclosure wall 54 and is coupled to interior 56 of the enclosure by virtue of operating rods 58. The plurality of operating rods 58 transfer keystroke motions from an external keypad overlay (shown in FIG. 4) to one or more keys or switches corresponding to an internal switch matrix (also shown in FIG. 4) thus sending an electrical keystroke or other suitable signal to circuitry inside the explosion proof enclosure. Rods 58 can be formed of any suitable material as long as the material is able to pass the applicable approval(s). In some embodiments, rods 58 are formed of a metal such as stainless steel. Rods 58 are sized relative to apertures 60 through wall 54 such that the gap between the outside diameter or outer dimension of each rod 58 and the diameter or dimension of aperture 60 is very narrow. In some embodiments where enclosure wall is constructed from aluminum, apertures 60, and potentially other portions of the enclosure, are anodized to provide a coating of anodization. In embodiments where anodization is performed on apertures 60, the thickness of the anodization is controlled to be 0.003" or less. Additionally, any suitable grease or coating can be used to facilitate movement of the rods 58. One particular example of a suitable grease is sold under the trade designation Krytox® GPL225, available from E.I. du Pont de Nemours and Company, of Wilmington, Del. Krytox® GPL225 is a non-conductive, anticorrosion grease that contains sodium nitrite. The grease not only facilitates movement of rods 58, but also provides rust protection at ambient temperature; corrosion protection at elevated temperatures; and antiwear protection.

The narrow gap between the outer diameter of each rod 58 and the inner diameter of a respective aperture 60 coupled with the length of the gap provides a suitable flame quenching path such that any flame or explosion generated or initiated within the electronics enclosure cannot escape though the gap. In this manner, the flame quenching paths provided by rods 58 facilitates compliance with applicable industry-accepted standards from approval agencies such as CSA, UL, FM, ATEX and IEC to provide flame and explosion safe operation. The dimensions of the gap and length may be varied based upon design considerations as long as they comply with applicable flameproof standards. Rods 58 also include retainer features such that they cannot be expelled from the device even in the event of explosive forces within the enclosure. In the embodiment illustrated in FIG. 3, such retainer features are provided by annular notches 62 located on a portion of each rod that is inside the enclosure. Each notch 62 cooperates with a disc-shaped retainer 64 that will not pass through aperture 60. In some embodiments, disc-shaped retainer 64 may be a known snap ring, e-clip, or any other suitable mechanical retainer. Additionally, embodiments of the present invention can be practiced where the retainer is an integral portion of each rod 58. For example, rods 58 may be machined to have an annular ring with a larger diameter that is not able to pass through apertures 60.

Figure 4:
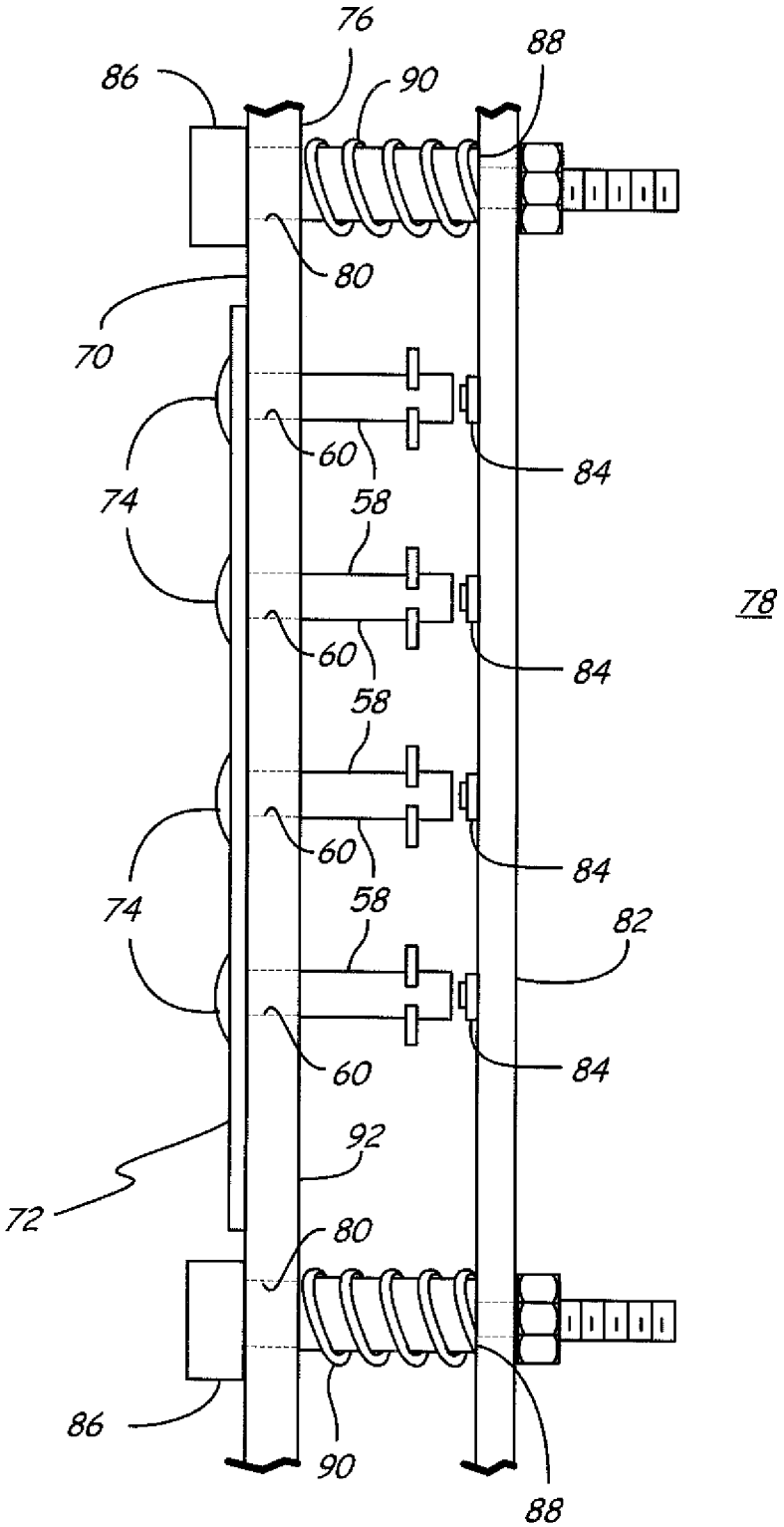
FIG. 4 is a cross-sectional view of an operator interface mounted to an explosion proof enclosure in accordance with an embodiment of the present invention.

FIG. 4 is a cross sectional view of an operator interface mounted to an explosion proof enclosure in accordance with an embodiment of the present invention. A reference flat surface 70 is machined, or otherwise provided, on the exterior of the explosion proof enclosure. In some embodiments, an exterior keypad overlay 72 comprised of one or more "domed" keys or buttons 74 is adhesively mounted to flat reference surface 70. However, in other embodiments, no exterior keypad overlay is provided and the ends of operating rods 58 may form buttons that are directly contacted by an operator. In some embodiments, keypad overlay 72 provides for environmental sealing. Apertures 60 are machined, or otherwise provided, in surface 70 and enclosure wall 76 through to interior 78 of the enclosure. In one embodiment, domed keys 74 are arranged in a matrix. For each key 74, an operating rod 58 is provided that is preferably concentric with each domed key 74. Additional mounting holes 80 are machined through reference surface 70 to interior 78 to provide for mounting key switch plate 82 inside the enclosure and parallel with reference surface 70. Key switch plate 82 has a number of electrical switches 84 that are disposed to be actuated by respective operating rods 58. In some embodiments, the internal key switch pad may be comprised of a domed spring membrane keypad where the domed springs provide return force and tactile feedback on operating rods 58. In some embodiments, the internal key switch pad can be provided by an adhesive membrane keypad assembly mounted to a flat metal plate or printed circuit board assembly. Additionally, an external keypad can also be mounted to reference surface 70 with similar characteristic to the internal key switch pad. For example, the external keypad can have domed keys having the same operating stroke as required to engage the internal key switches or actuators. Thus an externally applied operating motion is directly transferred to the internal switching or actuating components by the operating rods 58.

In some embodiments, electrical switches 84 are coupled to suitable circuitry (not shown) that registers the momentary switch actuation as an operator keystroke. However, embodiments of the present invention can also be practiced where an individual switch 84 is coupled directly to any suitable electrical component, such as for example, a power supply or solenoid valve. The distance from reference surface 70 to key switch plate 82 is nominally the length of operating rods 58. Mounting holes 80 may be counterbored to a controlled depth from reference surface 70 such that a common (e.g. ISO 7379 or similar) shoulder screw head 86 will stop at this counterbore controlling the screw insertion depth. However, in other embodiments, such as that shown in FIG. 4, the shoulder screw head 86 may come to rest on reference surface 70. The opposite end 88 of the shoulder screw is a controlled distance from shoulder screw head 86 such that, when screwed into key switch plate 82, these features create a controlled distance between reference surface 70 and key switch plate 82. This assembly has no reference to the interior enclosure surfaces, only the exterior. A generous clearance is preferably provided between key switch plate 82 and the interior of the explosion proof enclosure to allow for expected variations in the thickness of wall 76. Since this assembly is free to translate outward along the axis of the shoulder screws, a spring element 90 is provided between interior surface 92 of enclosure wall 76 and key switch plate 82 to bias the assembly inward and to place the shoulder screws in tension. This ability to translate in no way influences the flame and explosion protection provided by the gap between the shoulder screws and operating rods 58 and their respective apertures.

Figure 5:
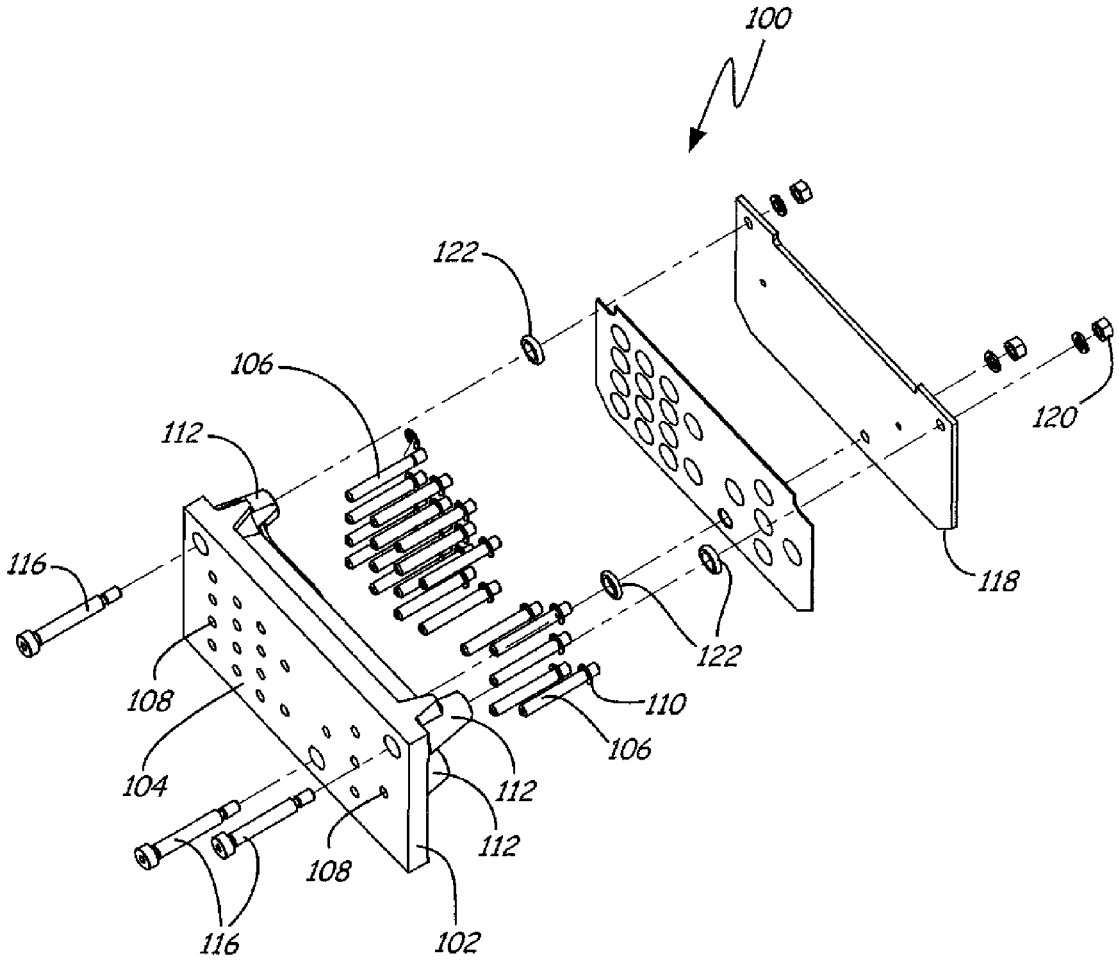
FIGS. 5 and 6 are diagrammatic exploded perspective views of an operator interface in accordance with an embodiment of the present invention.
Figure 6:
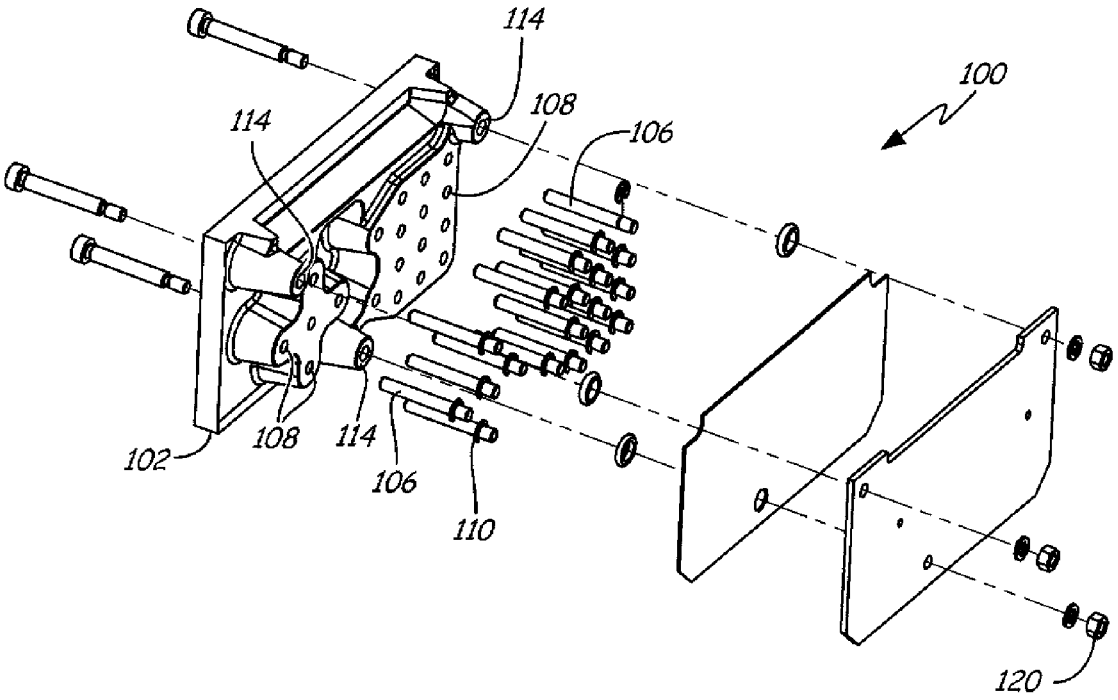

FIGS. 5 and 6 are diagrammatic exploded perspective views of an operator interface in accordance with an embodiment of the present invention. Operator interface 100 includes plate 102 that may be mounted to or integral with an electronics enclosure such as enclosure 16 set forth above. In some embodiments, plate 102 is formed of cast aluminum and includes reference surface 104. A number of operating rods 106 are provided that pass through apertures 108 in plate 102. Each rod 106 includes, or is coupled to, a retainer 110 that is sized such that it may not pass through apertures 108. Plate 102 includes three standoffs or bosses 112 that provide support for the three shoulder screws 116. In the embodiment shown in FIGS. 5 and 6, three shoulder bolts 116 provide a controlled distance from reference surface 104 to rigid plate 118 since the shoulder portion 128 (shown in FIG. 8) of each bolt 116 extends beyond surface 114 of standoff 112. Bolts 116 pass through plate 102, standoffs 112 and fixed plate 118. Elastomeric o-rings 122 are disposed about each shoulder bolt 116 between surfaces 114 of standoffs 112 and plate 118. Thus, as nuts 120 are tightened upon each respective shoulder bolt 116, each respective elastomeric o-ring 122 is compressed thereby placing the shoulder bolt 116 in tension. In some embodiments, the elastomeric o-ring is formed of rubber. However, embodiments of the present invention can also be practiced where elastomeric o-rings 122 are replaced with another suitable structure, such as a spacer, wave washer, et cetera.

Figure 7:
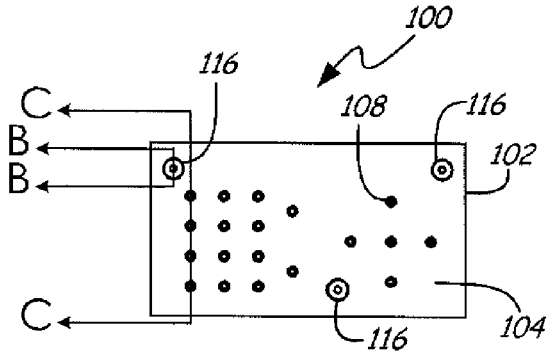
FIG. 7 is a diagrammatic front elevation view of an operator interface in accordance with an embodiment of the present invention.

FIG. 7 is a diagrammatic front elevation view of an operator interface in accordance with an embodiment of the present invention. Plate 102 includes reference surface 104 having a plurality of apertures 108 therethrough. Three shoulder bolts 116 draw the fixed backing plate 118 (shown in FIG. 8) toward reference surface 104 to hold the entire operator interface assembly together.

Figure 8:
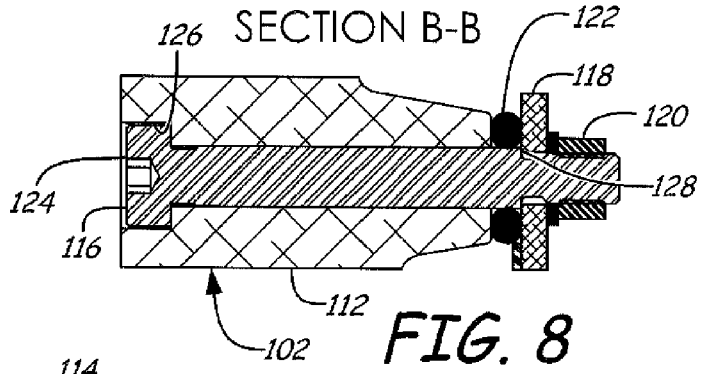
FIG. 8 is a diagrammatic cross-sectional view taken along line B-B in FIG. 7 of a portion of an operator interface in accordance with an embodiment of the present invention.

FIG. 8 is a diagrammatic cross-sectional view taken along line B-B in FIG. 7 of a portion of an operator interface in accordance with an embodiment of the present invention. Shoulder bolt 116 has a head 124 that is countersunk within bore 126. Shoulder bolt 116 passes through standoff 112 of plate 102. The shoulder 128 of shoulder bolt 116 extends beyond surface 114 of standoff 112 by a distance that is less than the diameter of o-ring 122. Thus, as nut 120 is tightened completely, fixed plate 118 bears directly against shoulder 128 and applies a certain amount of compression to o-ring 122 based. The compression force is selected in the design based on the durometer rating of the elastomer and the difference between the distance that shoulder 128 extends beyond surface 114 and the cross-sectional diameter of o-ring 122.

Figure 9:
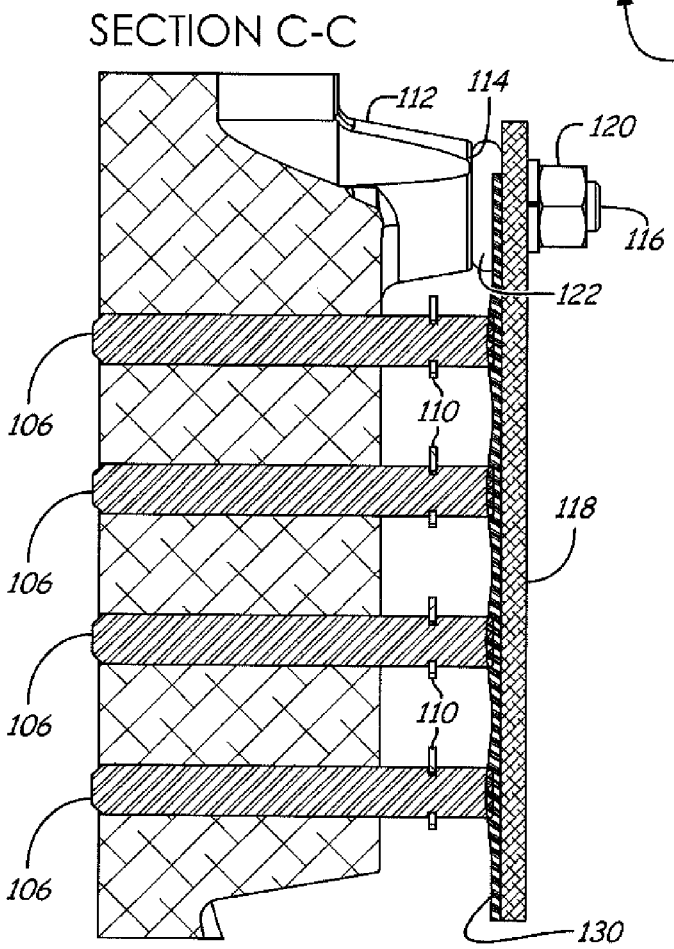
FIG. 9 is a diagrammatic cross-sectional view taken along line C-C in FIG. 7 of a portion of an operator interface in accordance with an embodiment of the present invention.

FIG. 9 is a diagrammatic cross-sectional view taken along line C-C in FIG. 7 of a portion of an operator interface in accordance with an embodiment of the present invention. FIG. 9 shows four operating rods 106 passing through plate 102 to contact an internal switch matrix 130. FIG. 9 also shows o-ring 122 compressed between surface 114 of standoff 112 and plate 118. Notably, in some embodiments, at least a portion of internal switch matrix or layer 130 may be disposed between o-ring 122 and fixed plate 118.

While the embodiments illustrated above use a plurality of shoulder screws or bolts to define the controlled distance between reference surface 70 and the key switch plate, other arrangements can be employed in accordance with embodiments of the present invention. Specifically, the controlled distance could also be established by a conventional screw and controlled length bushing.

In some embodiments, a membrane keypad need not be used, but instead a matrix of keys similar to a conventional keyboard can be employed. In such embodiments additional or alternative spring elements may be provided for spring return feel for the operating rods. It would also be possible to create a larger flameproof keyboard assembly with such an.

In some embodiments, one or more of the buttons may include features or a mechanism to lock the switch associated with that button into an open or depressed state. This would provide a lockout/tagout function. Similarly, some embodiments may include one or more operating rods that are used to provide rotary (vs. translational) motion to provide a similar function. In such embodiments, a knob or other suitable rotary structure is affixed to the portion of the operating rod that is external to the explosion proof enclosure, while the internal surface is coupled to a suitable potentiometer or rotary encoder. Thus, the operating rod functions to translate rotation of the knob to the potentiometer or encoder while still providing a flame quenching path through the wall of the explosion proof enclosure. Moreover, the rotary and translational embodiments are not necessarily exclusive. For example, some controls may be button while others are knobs. Further, a single control may be configured to provide both rotational control (knob) and pushbutton control. Thus, an operator may rotate the control to provide one function and then push the control to provide another function. For example, a rotation may be used to adjust a machine parameter which, once adjusted, is locked to the adjusted parameter by pushing (axially translating) the knob or rotary control.

Although the present invention has been described with reference to preferred embodiments, workers skilled in the art will recognize that changes may be made in form and detail without departing from the spirit and scope of the invention.

What is claimed is:

1. A process analytic device comprising:
- a metallic enclosure having electronics disposed therein, the enclosure having an enclosure wall with a reference surface;
- a plurality of operating rods, each operating rod being configured to pass through a respective aperture in the enclosure wall and to cooperate with the enclosure wall to provide a flame quenching pathway;
- a plurality of electrical switches, each electrical switch being aligned with a respective operating rod, and being mounted a controlled distance from the reference surface, wherein the controlled distance is established by a plurality of shoulder screws;
- an elastomeric o-ring disposed about each shoulder screw to place a selected amount of tension on each shoulder screw; and
- wherein each operating rod transfers movement to a respective electrical switch through the flame quenching pathway.

2. The process analytic device of claim 1, and further comprising a plurality of buttons arranged on the reference surface, wherein each operating rod transfers movement from a respective button to a respective switch through the flame quenching pathway.

3. The process analytic device of claim 2, wherein the plurality of buttons is provided by an adhesive keypad overlay.

4. The process analytic device of claim 3, wherein the adhesive keypad overlay provides for environmental sealing.

5. The process analytic device of claim 2, wherein the plurality of buttons is arranged to create a keypad for control of the device.

6. The process analytic device of claim 2, wherein at least one of the buttons is coupled to circuitry such that depressing the button is registered as a keystroke by the circuitry.

7. The process analytic device of claim 2, wherein at least one of the buttons is coupled to an electrical component such that the button directly affects operation of the electrical component.

8. The process analytic device of claim 7, wherein the electrical component is a power supply.

9. The process analytic device of claim 7, wherein the electrical component is a solenoid valve.

10. The process analytic device of claim 1, wherein the plurality of electrical switches comprises an internal key switch pad that includes a domed spring membrane keypad where domed springs provide return force and tactile feedback on the operating rods.

11. The process analytic device of claim 10, and further comprising an external membrane keypad with domed keys having the same operating stroke as required to engage the switches of the internal key switch pad.

12. The process analytic device of claim 1, wherein the elastomeric o-ring is formed of rubber.

13. The process analytic device of claim 1, wherein the controlled distance is established by a conventional screw and controlled length bushing.

14. The process analytic device of claim 1, wherein the plurality of electrical switches comprise an internal key switch pad that is constructed by an adhesive membrane keypad assembly mounted to a flat plate.

15. The process analytic device of claim 1, wherein the plurality of electrical switches is mounted to an internal key switch plate constructed from a flat plate.

16. The process analytic device of claim 15, wherein the flat plate is a printed circuit board.

17. The process analytic device of claim 15, wherein the flat plate is positioned parallel to the reference surface.

18. The process analytic device of claim 1, wherein each operating rod is retained from expulsion from the enclosure.

19. The process analytic device of claim 1, and further comprising an electronic display.

20. The process analytic device of claim 19, wherein the display is an LCD.

21. The process analytic device of claim 1, and further comprising at least one rotary control disposed proximate the reference surface, the rotary control being coupled to an operating rod that transfers rotation of the rotary control through a flame quenching pathway to an electrical component.

22. The process analytic device of claim 21, wherein the electrical component is a potentiometer

23. The process analytic device of claim 21, wherein the electrical component is a rotary encoder.

24. The process analytic device of claim 1, wherein the metallic enclosure is explosion proof.

25. The process analytic device of claim 1, wherein the metallic enclosure is formed of aluminum and each aperture is anodized.

26. The process analytic device of claim 25, wherein anodization thickness for each aperture is no greater than about 0.003".

27. The process analytic device of claim 1, and further comprising non-conductive grease disposed between each aperture and each respective operating rod.

28. The process analytic device of claim 27, wherein the non-conductive grease contains sodium nitrite.

* * * * *

UNITED STATES PATENT AND TRADEMARK OFFICE

CERTIFICATE OF CORRECTION

PATENT NO. : 9,006,590 B2
APPLICATION NO. : 13/566380
DATED : April 14, 2015
INVENTOR(S) : Edward J. Bailey et al.

It is certified that error appears in the above-identified patent and that said Letters Patent is hereby corrected as shown below:

In the Claims

Column 8, Claim 22:
Line 9:

after "potentiometer" insert a --.--

Signed and Sealed this
First Day of March, 2016

Michelle K. Lee

Michelle K. Lee
*Director of the United States Patent and Trademark Office*